US005861862A

United States Patent [19]

Akiyama

[11] Patent Number: 5,861,862

[45] Date of Patent: Jan. 19, 1999

[54] LIQUID CRYSTAL DISPLAY DEVICE REALIZING A SMALL SIZE BY REDUCING NUMBER ON INPUT/OUTPUT TERMINALS

[75] Inventor: Takashi Akiyama, Sayama, Japan

[73] Assignee: Citizen Watch Co., Ltd., Tokyo, Japan

[21] Appl. No.: 805,320

[22] Filed: Feb. 24, 1997

Related U.S. Application Data

[63] Continuation of Ser. No. 351,255, filed as PCT/JP94/00600 filed Apr. 8, 1994, abandoned.

[30] Foreign Application Priority Data

Apr. 9, 1993 [JP] Japan ..... 5-023753 U

[51] Int. Cl.[6] ..... G09G 3/36

[52] U.S. Cl. ..... 345/96; 345/99

[58] Field of Search ..... 345/87, 92, 94, 345/96, 97, 98, 99, 100; 359/54, 56, 59, 60; 348/790, 792, 793, 15, 16; H04N 9/31, 3/14, 7/14

[56] References Cited

U.S. PATENT DOCUMENTS

| | | | |
|---|---|---|---|
| 5,117,298 | 5/1992 | Hirai | 345/96 |
| 5,191,450 | 3/1993 | Tajima et al. | 345/88 |
| 5,206,634 | 4/1993 | Matsumoto et al. | 345/99 |
| 5,301,031 | 4/1994 | Eto et al. | 348/792 |
| 5,357,290 | 10/1994 | Horibe | 348/792 |

FOREIGN PATENT DOCUMENTS

| | | |
|---|---|---|
| 62-156624 | 7/1987 | Japan . |
| 1-193897 | 8/1989 | Japan . |
| 2-271388 | 11/1990 | Japan . |
| 4-195086 | 7/1992 | Japan . |
| 4-355435 | 12/1992 | Japan . |

*Primary Examiner*—Chanh Nguyen
*Attorney, Agent, or Firm*—Finnegan, Henderson, Farabow, Garrett & Dunner, L.L.P.

[57] ABSTRACT

A reduction in the number of input/output terminals of the scan electrode drive circuit or signal electrode drive circuit to enable a compact liquid crystal display device. The scan direction is established by the polarity relationship between the sequential scan start signal TPR of the scan electrode drive circuit and the sequential scan timing signal CK. The left-to-right direction of the output data is established by the polarity relationship of the display data latch signal CL of the signal electrode drive circuit and the signal electrode drive voltage output signal CL2. By doing this, the number of input/output terminals required on the scan electrode drive circuit or the signal electrode drive circuit is reduced, enabling implementation of a compact liquid crystal display device.

3 Claims, 11 Drawing Sheets

LIQUID CRYSTAL DISPLAY DEVICE REALIZING A SMALL SIZE BY REDUCING NUMBER ON INPUT/OUTPUT TERMINALS

This application is a continuation of application Ser. No. 08/351.255 filed Dec. 8. 1994 now abandoned, which is a 371 of PCT/JP94/00600, filed Apr. 8. 1994.

1. Technical of Field

The present invention relates to a liquid crystal display device which has scan electrodes and signal electrodes.

2. Background Art

In a liquid crystal display device, there are cases in which the construction or desired display effect requires that the displayed image be inverted top-to-bottom. To achieve this top/-to-bottom inversion, there is a method of switching the scanning direction in the scan electrode drive circuit.

FIG. 10 shows the block diagram of an example of a system using a MIM active matrix and having a top-to-bottom inversion function. In FIG. 10, video signal 102 is input to controller 2101, and is quantized by an A/D converter within controller 2101. The quantized 4-bit data 120 is output to memory 104 within the signal electrode drive circuit 103 via FPC2114. FPC2114 is a flexible printed circuit which makes connection between the long side of the signal electrode drive circuit 103 within the liquid crystal panel and the circuit board. The signal electrode drive circuit 103 has memory 104 and output circuit 105, and is connected to each of the signal electrodes of the liquid crystal panel 108. The six types of voltages required to drive the MIM are generated from power supply 100, of these six types two signal electrode drive voltages 119 are output to the output circuit 105 within the signal electrode drive circuit via FEC2114. The remaining four scan electrode drive voltages 118 are output as scan electrode output voltages to the scan electrode drive circuit 2111 via FPC2114. This FPC2114 makes the connection between the ends of the scan electrodes and the long side of circuit 2111.

From the controller 2101, timing clock CL, for the purpose of latching 4-bit data 120 into memory 104, and timing clock CL2, for the purpose of outputting a data signal in synchronization with a horizontal synchronization signal, are output to the signal electrode drive circuit 103 via FPC2114, with scan selection signal CK which establishes the timing of sequential scan selection, scan start signal TPR which establishes the timing of the start of scanning, and top-to-bottom inversion switching signal UD which establishes the top/bottom scan direction, being output to level shifter 109. Level shifter 109 outputs to the scan electrode drive circuit via FPC2114 a scan selection signal CK, scan start signal TPR, and top-to-bottom inversion switching signal UD which are shifted to the power supply voltage of the scanning electrode drive circuit 2111. The output terminals of the scan electrode drive circuit 2111 are each connected to the scan electrodes of the liquid crystal panel 108. Within the liquid crystal panel 108, scan electrode-S 113 is the uppermost scan electrode on the screen and scan electrode-E 114 is the lowermost scan electrode on the screen.

FIG. 7 shows the timing of the various signals for the case in which scanning is done from scan electrode-S 113 in the direction of scan electrode-E 114 in the system shown in FIG. 10. In FIG. 7, CL is a latch clock that only during the picture interval of the video signal and is a latch clock that repeats the states of 0 and 1 during one horizontal interval, CL2 is a clock of only during the picture interval and is output just one time, in synchronization with the horizontal synchronization signal, during the picture interval, TPR is a clock that is output just one time during the picture interval, at the beginning of one field interval, CK is a clock which is output in synchronization with CL2, and UD is 1 state during the entire frame interval. Video signal 102, after being quantized into 4-bit data 120 by means of the A/ID converter within the controller 2101, is stored into the memory 104 within the signal electrode drive circuit 103 by clock CK. The stored data is converted within the output circuit 105 to an output voltage in accordance with the data at the time of the next occurrence of CL2 and applied to the signal electrode. This is repeated for each horizontal interval. The scan electrode selection during this process is done so that scan electrode-S 113 is selected at the timing of the first CK after the output of TPR, with the next scan electrode after scan electrode-S 113 selected at the timing of the next CK. This is repeated for each horizontal scan interval within one field, until finally the scan electrode-E 114 is selected. When the above operations are repeated for each field, the display image scanning in the direction from S113 to E114 is obtained on the liquid crystal panel. FIG. 8 shows the manner in which the image is displayed on liquid crystal panel 108.

Next, in the case in which the scan direction is from scan electrode-E 114 in the direction toward scan electrode-S 113, the signals CK, CL2, TPR, and CK are output with the timing shown in FIG. 7, with only the top-to-bottom inversion switching signal UD output in the zero state during the entire period. FIG. 9 shows the manner in which the image is displayed on the liquid crystal panel 108 in this case.

As described above, the scan direction of the scan electrodes is established by the state of the top-to-bottom inversion switching signal UD, the image being the normal image when this signal is constantly in the 1 state and inverted top-to-bottom when this terminal is constantly in the 0 state.

However, there has been a problem that has been pointed out in implementing a compact liquid crystal panel using the above-described prior art. The number of signals required to drive the signal electrode drive circuit and the scan electrode drive circuit depends upon the number of drive voltages for these circuits and the number of clocks. These signal lines are connected to the scan electrode drive circuit and signal electrode drive circuit within the liquid crystal panel by means of an FPC. In the past, because input terminals were provided on the long side of the scan electrode drive circuit for the scan electrode drive circuit and input terminals were provided on the short side of the signal electrode drive circuit for the signal electrode drive circuit, the FPC extended beyond the outer dimensions of the liquid crystal panel, making the actual outer dimensions of the liquid crystal panel larger by the amount of the FPC's extension over the dimension of the liquid crystal panel itself. To eliminate the influence that the FPC has on the outer dimensions, a method of providing input/output terminals of the scan electrode drive circuit on the short side of the scan electrode drive circuit has been shown (Japanese Unexamined Patent Publication, No. 04-355435).

However, when using this method, there is a limit to the number of input/output terminals. The maximum number of input/output terminals that can be provided on the short side of the of the liquid crystal panel is determined by the minimum width of the wiring making connection to the FPC. This maximum number of input/output terminals is considerable smaller than for the long side. In the prior art, a total of seven signals were required for use in the scan electrode drive circuit, making it necessary to provide seven input/output terminals on the short side of the scan electrode drive circuit, but the connecting resistors of the FPC and wiring resistors of the liquid crystal panel become expensive, and influence the display quality of the liquid crystal panel. Bad FPC connections also occur, thus affecting yield. Therefore, to be able to provide input/output terminals on the short side, there remained the problem of reducing the number of input/output terminals required compared to the number required in the past. There also remained the same problem with regard to the signal electrode drive circuit.

An object of the present invention is to provide a liquid crystal panel which has fewer numbers of signal lines of the scan electrode drive circuit and of the signal electrode drive circuit.

DISCLOSURE OF INVENTION

To achieve the above-noted object, the present invention has a liquid crystal panel, and a scan electrode drive circuit and signal electrode drive circuit which drive the liquid crystal panel in accordance with signals from a controller, the scan electrode drive circuit and signal electrode drive circuit each capable of being set to at least two operating states, wherein a means of detecting the mutual lead/lag phase relationship of two arbitrary signals which differ in phase is provided within the scan electrode drive circuit or signal electrode drive circuit, the two operating states of either the scan electrode drive circuit or signal electrode being set as a result of detecting the mutual phase relationship of the two arbitrary signals which differ in phase.

BEST MODE FOR CARRYING OUT THE INVENTION (First Embodiment)

Figure 1:
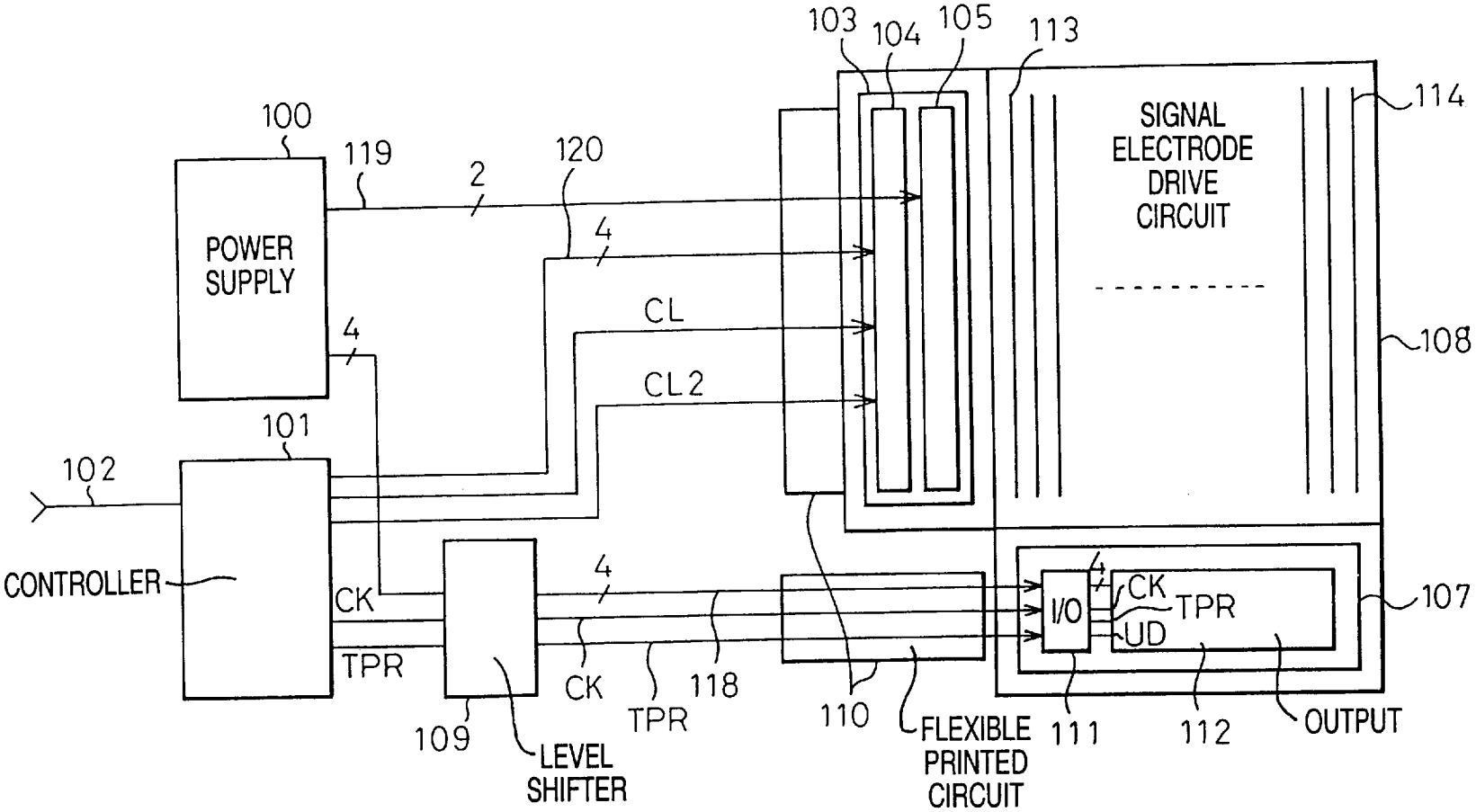
FIG. 1 is a block diagram of the first embodiment of the present invention.

The first embodiment of the present invention will be described below, with reference made to FIG. 1 through FIG. 6. FIG. 1 is a block diagram of the liquid crystal display device of this embodiment. Video signal 102 is output to controller 101, two signal electrode drive voltages 119 from power supply 100 are output to signal electrode drive circuit 103 via FPC 110, and four scan electrode drive voltages 118 are output to input/output terminals on the short side of scan electrode drive circuit 107 via level shifter 109 and FPC110. From the controller 101, a scan selection signal CK, which establishes the timing of the sequential scanning of the scan electrodes, and a scan start signal TPR, which establishes the timing of the start of the scan of the scan electrodes, are output to level shifter 109, and after the level shifting, these signals are output via FPC 110 to input/output control block 111 within scan electrode drive circuit 107. The latch clock CL of the signal electrode drive circuit 103, the clock CL2 which establishes the timing of the output to signal electrodes, and the 4 bits data 120 are output to the signal electrode drive circuit 103. The scan electrode drive circuit 107 consists of an input/output control block 111 and an output block 112, the output terminals of output block 112 being connected to each of the scan electrodes within the liquid crystal panel 108.

Figure 2:
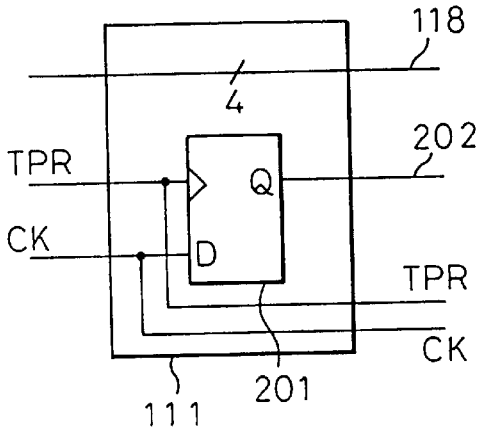
FIG. 2 is an internal circuit diagram of the input/output control circuit that is a constituent element of the first, second, and third embodiments of the present invention.

FIG. 2 shows the internal circuit of the input/output control block 111 within the scan electrode drive circuit 107. The internal circuit of the input/output control block 111 consists of a D-type flip-flop 201, to the clock terminal of which is connected TPR and to the data input terminal of which is connected CK, the Q output, which is the switching signal 202, being output as the top-to-bottom switching signal UD to the UD terminal of the output block 112. The four scan electrode drive voltages 118 are output as is to the output block 112, with TPR and CK being output to output block 112, in addition to being output: to the D-type flip-flop 201. The D-type flip-flop 201 latches the data input signal at the rising edge of the clock input signal, and outputs this at the Q output.

Figure 3:
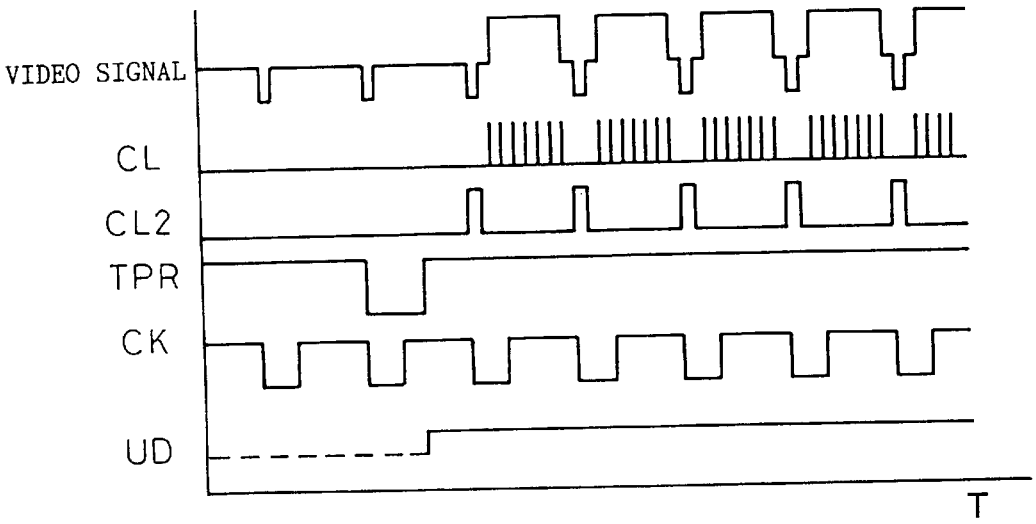
FIG. 3 is a timing chart of the downward-direction sequential scan in the first embodiment of the present invention.
Figure 4:
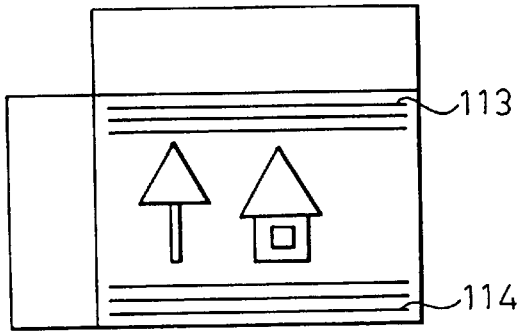
FIG. 4 is the displayed image of the downward-direction sequential scan in the first embodiment; of the present invention.

FIG. 3 shows the timing of the various signals in the liquid crystal display device of FIG. 1 when sequential scan is made in the direction from scan electrodes-S 113 to scan electrode-E 114. In FIG. 3, scan start signal TPR is the signal that establishes the timing of the start of the scan of scan electrodes, this signal being output just one time before the start of the video signal picture interval for during each field. The timing is such that the falling edge is synchronized to the horizontal synchronization signal, and the phase relationship is such that the state of CK is 1 at the rising edge. By means of the signal latch clock CL, display data is stored into memory 104 within the scan electrode drive circuit 103, with CL2 which is synchronized to the horizontal synchronization signal causing its output to the output circuit 105, and within the output circuit 105 signal electrode drive voltages corresponding to the display data are applied to the signal electrodes. The output block 112 within the scan electrode drive circuit 107 sequentially selects the scan electrode at the clock following the input of TPR. The establishment of the direction of the scan is done by the top-to-bottom switching signal UD, which is the switching signal 202 that is input from the input/output control block 111. When this signal is 1, the scan is done in the direction from scan electrode-S 113 to scan electrode-E 114, and when this signal is 0, the scan is done in the direction from scan electrode-E 114 to scan electrode-S 113. In the timing chart of FIG. 3, because CK is 1 at the time of the rising edge of TPR, the top-to-bottom switching signal UD is 1, so that sequential selection is made in the direction of scan electrodes from scan electrode-S 113 to scan electrode-E 114. At the input of TPR for the start of the scan for the next field as well, in the same manner, since TEPR and CK are input in such a manner that the phase relationship between them dictates that CK is 1 at the rising edge of TPR, the top-to-bottom switching signal UD will always be 1 for all field intervals, so that the display image on liquid crystal panel 108 is that of the from scan electrode from scan electrode-S 113 to scan electrode-E 114. FIG. 4 shows the display condition of the liquid crystal panel 108 when the scan direction is downward.

Figure 5:
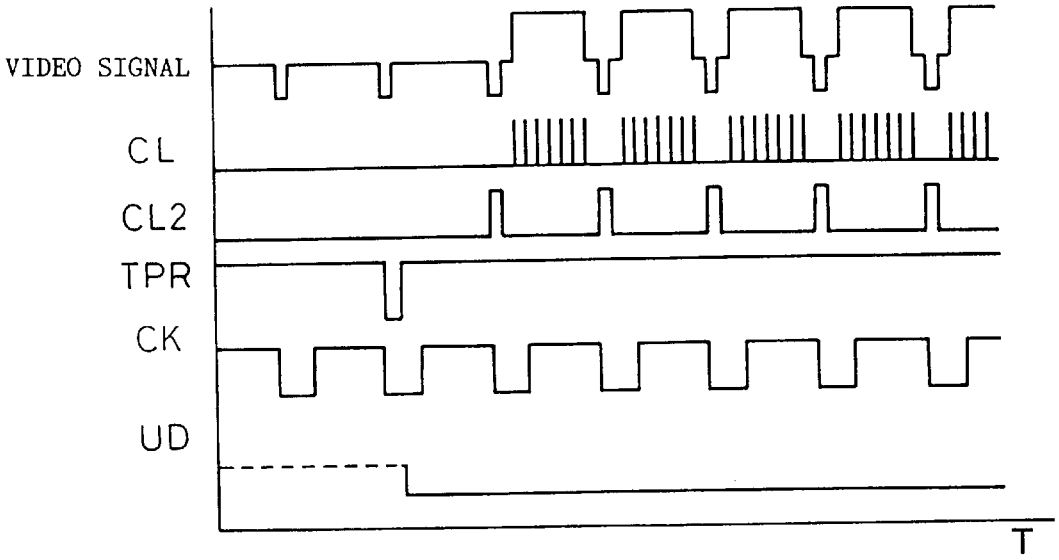
FIG. 5 is the timing chart of the upward-direction sequential scan in the first embodiment of the present invention.
Figure 6:
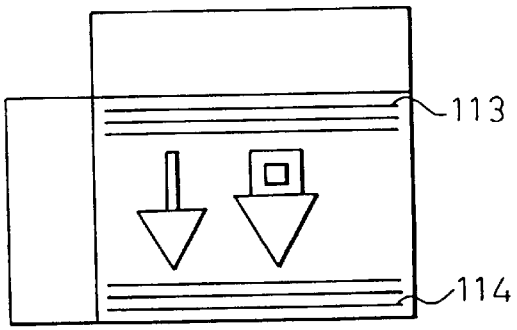
FIG. 6 is the displayed image of the upward-direction sequential scan in the first embodiment of the present invention.
Figure 7:
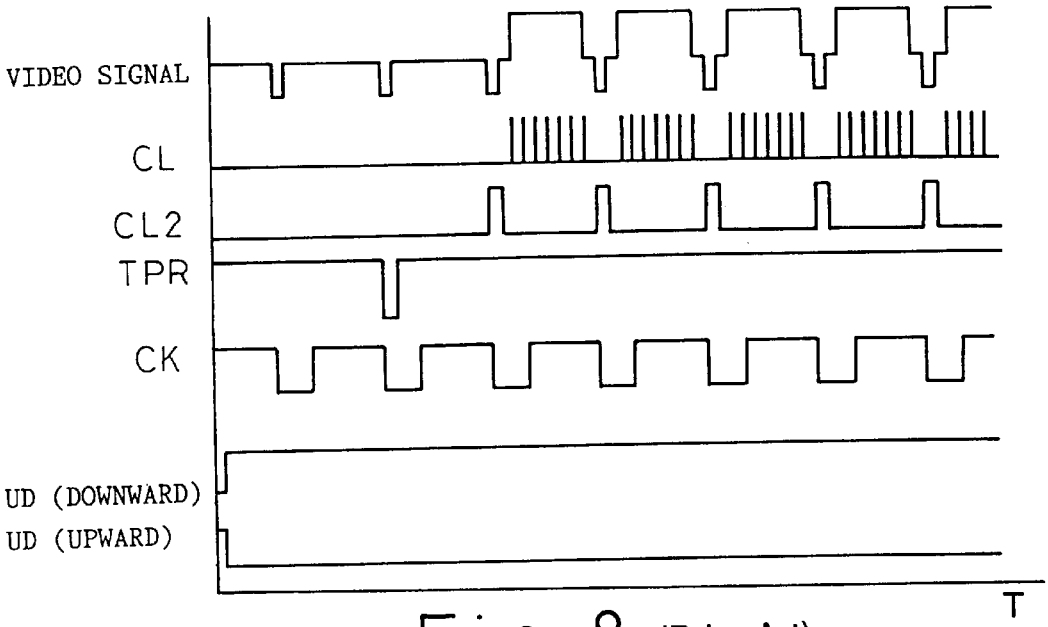
Fig. 7 (Prior Art)
FIG. 7 is the timing chart of the downward-direction sequential scan in the prior art.
Figure 8:
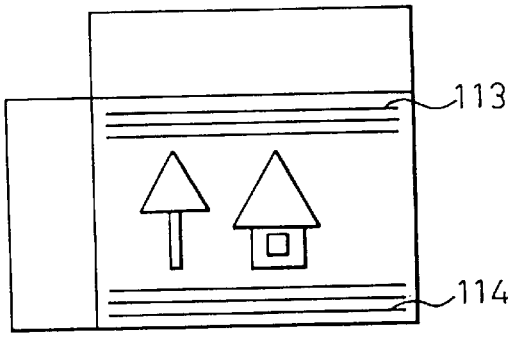
Fig. 8 (Prior Art)
FIG. 8 is the displayed image of the downward-direction sequential scan in the prior art.
Figure 9:
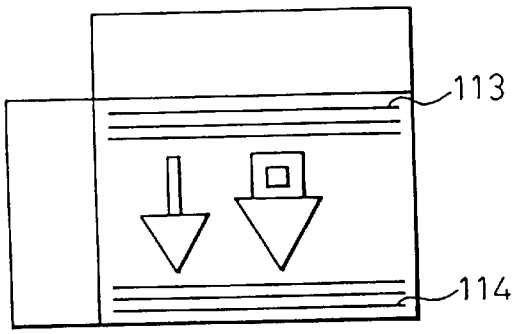
Fig. 9 (Prior Art)
FIG. 9 is the displayed image of the upward-direction sequential scan in the prior art.
Figure 10:
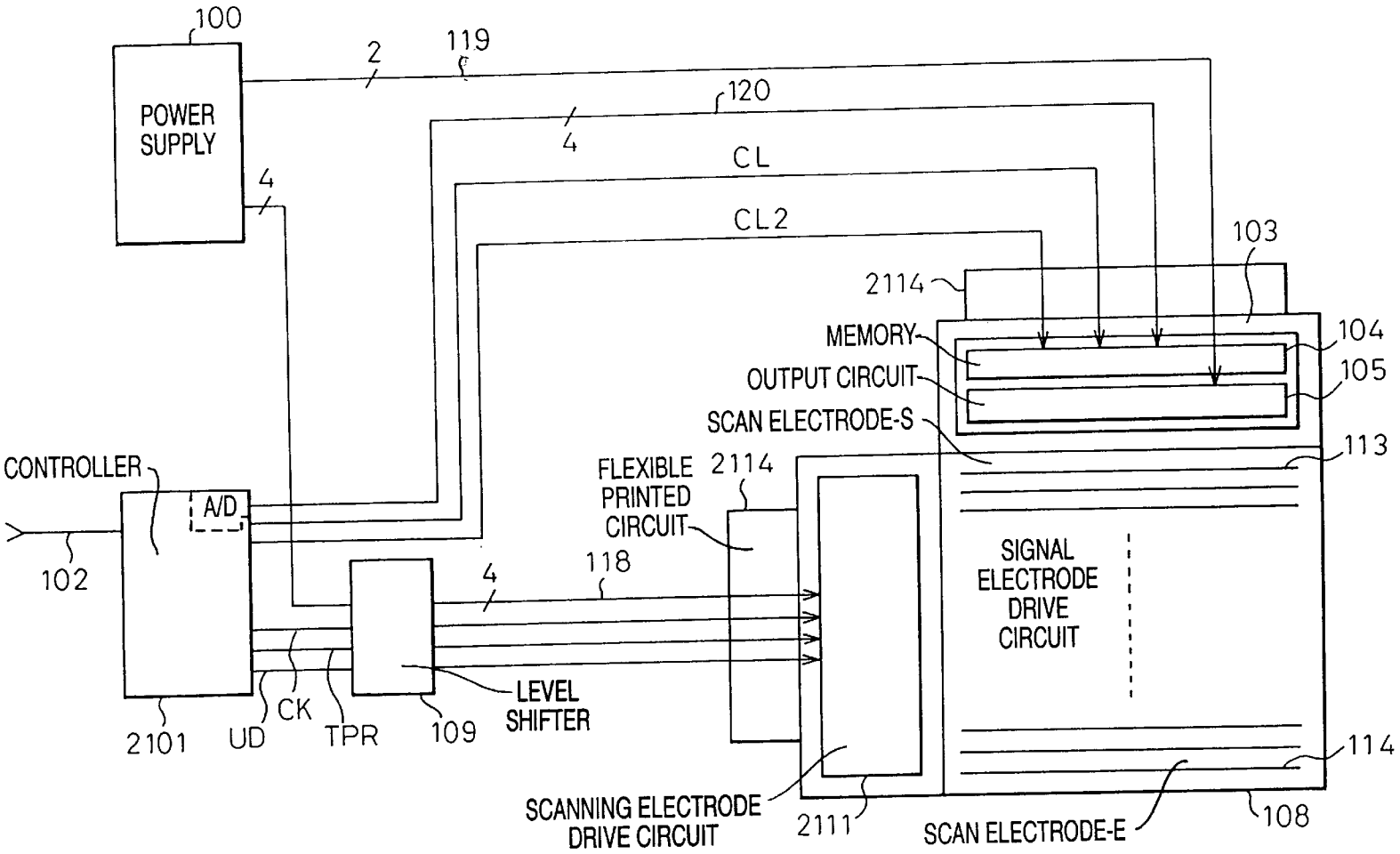
Fig.10 (Prior Art)
FIG. 10 is a block diagram of the prior art.

Next, the case in which the scan direction is reversed, that is, the case in which scanning is done in the direction towards S113 will be described. FIG. 5 shows the timing associated with this condition. The state of CK at the rising edge of TPR is 0. At that time, the switching signal 202 at the Q output of D-type flip-flop 201 is in the state 0, and is held at this state until the next TPR signal input occurs. The next TPR signal is also input so that CK is 0 at the rising edge of the TPR signal. Therefore, the state of the top-to-bottom switching signal UD is 0 during all the field intervals, so that a display image is obtained by scanning upward in the direction from scan electrode-E 114 to scan electrode-S 113. FIG. 6 shows the display condition of the liquid crystal panel 108 when the scan direction is upward.

In this manner, it is the phase relationship between TPR and CK in this embodiment that establishes the direction of the scan as upward or downward, so that if the phase relationship is maintained during all the field intervals, it is possible to establish the upward or downward orientation of the displayed image.

While the preceding has been a description of the up/down switching of the direction of the scan electrode drive circuit, by providing the circuit of FIG. 2 in the same manner to the signal electrode drive circuit 113, it is possible to use the phase relationship between clocks CL and CL2 to switch the left-to-right direction inversion as well.

x(Second Embodiment)

Figure 11:
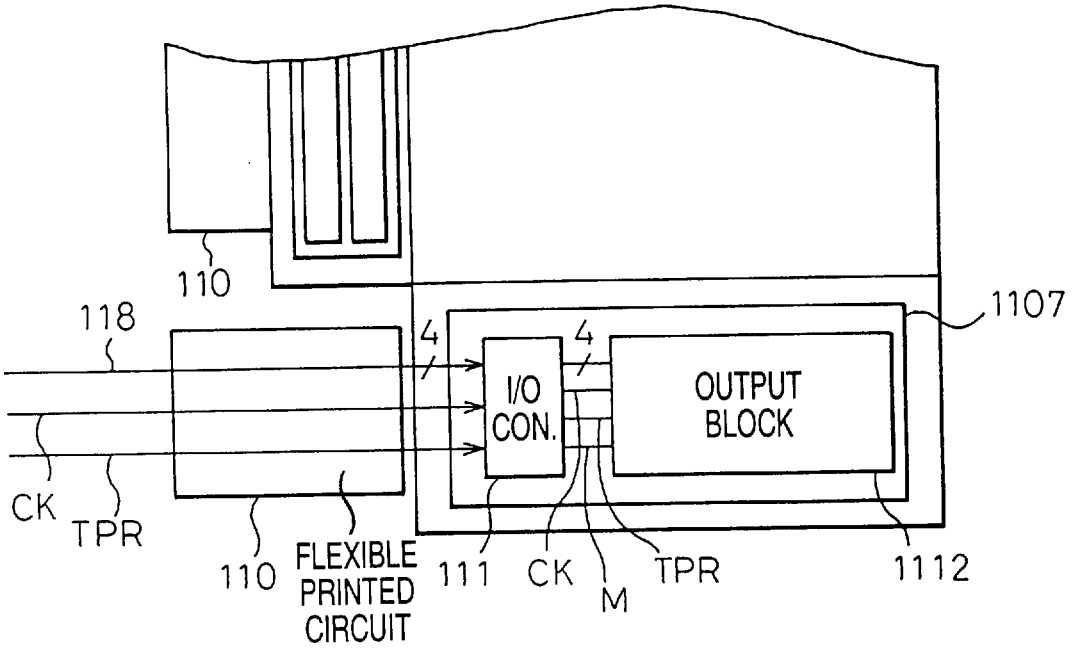
FIG. 11 is the scan electrode drive circuit; which is a constituent element of the second embodiment of the present invention.
Figure 12:
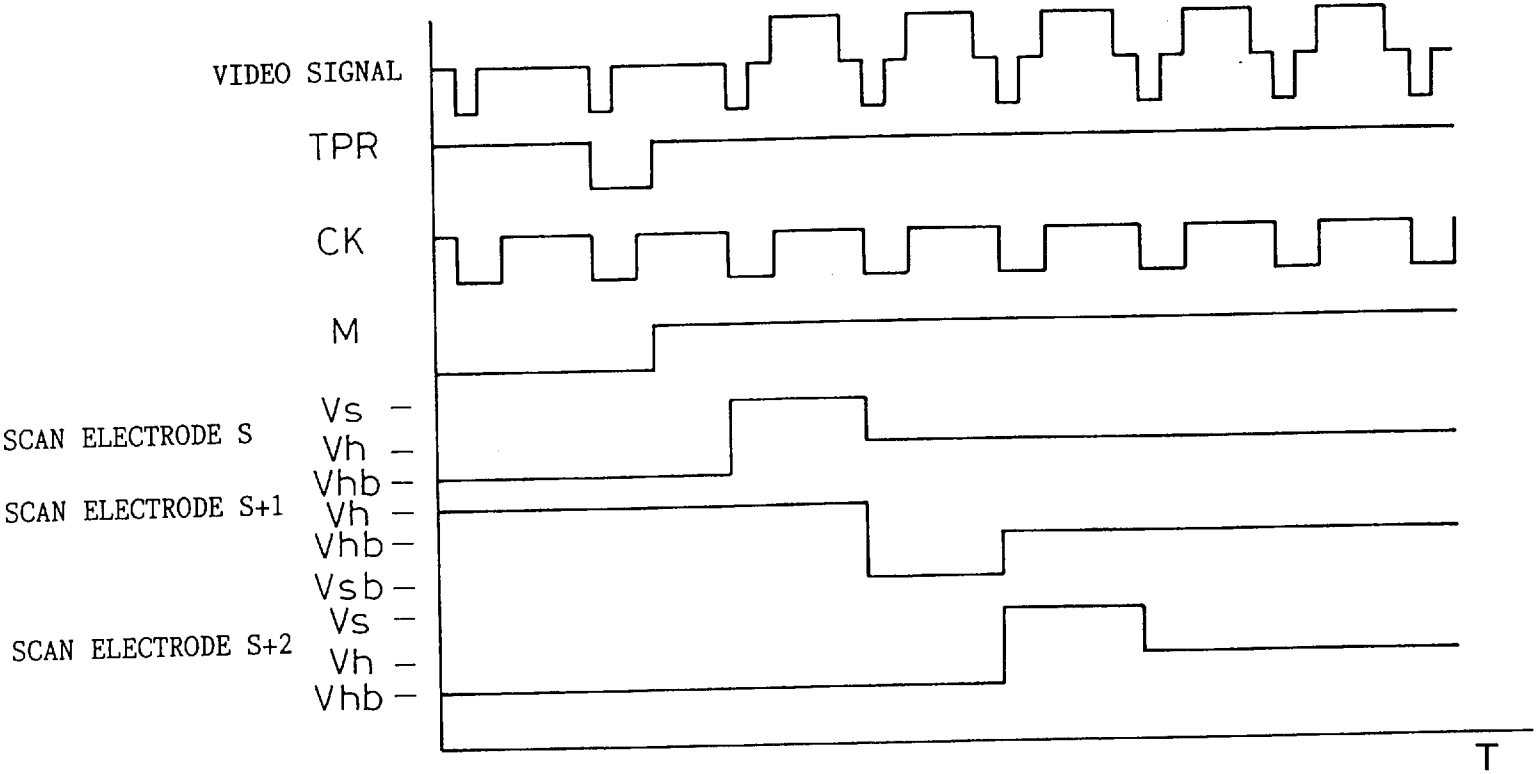
FIG. 12 is a timing chart for the case of the NTSC system in the second embodiment of the present invention.
Figure 13:
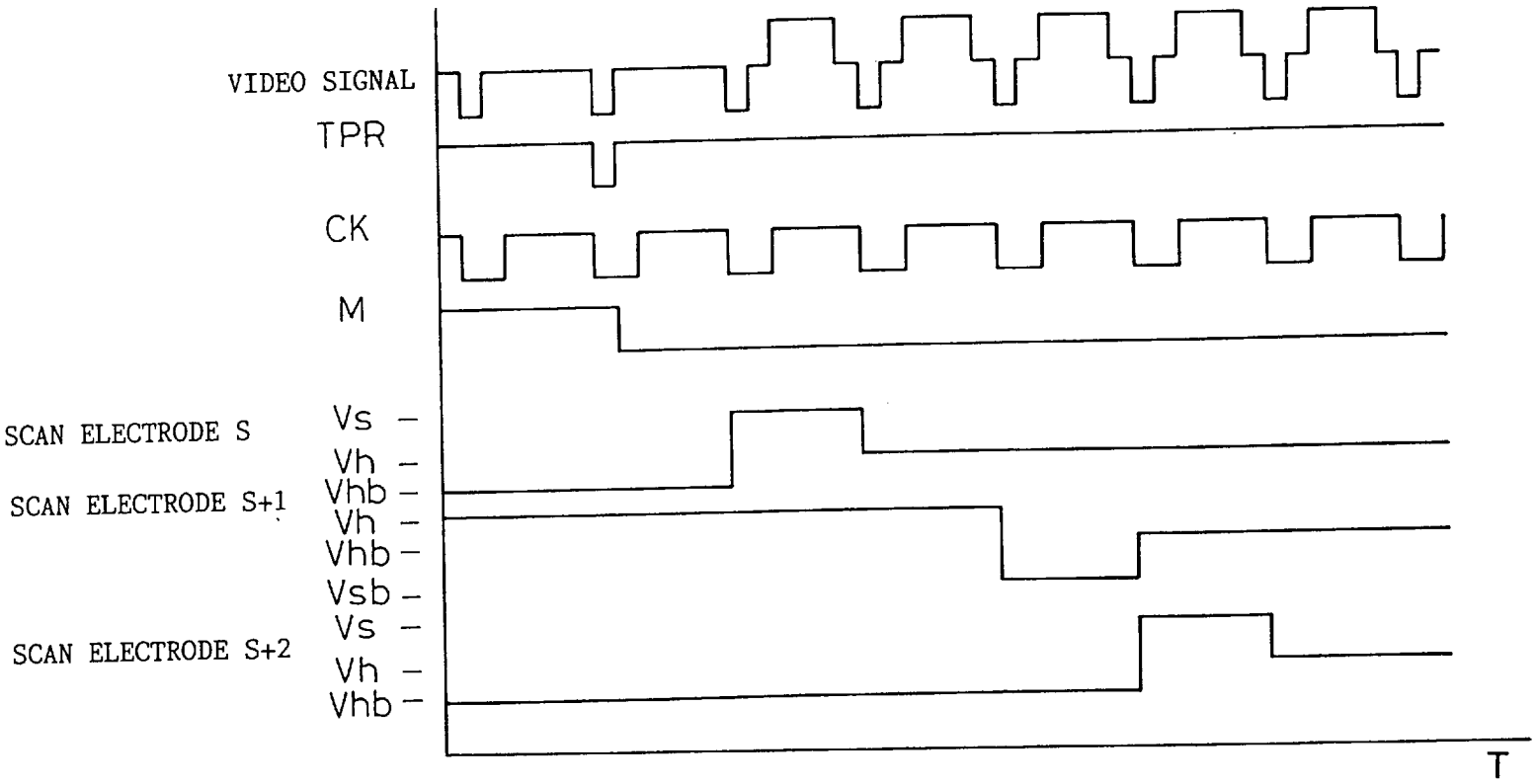
FIG. 13 is a timing chart for the case of the PAL system in the second embodiment of the present invention.

The following is a description of the second embodiment of the present invention, with reference made to FIG. 11 through FIG. 13. Since the block diagram of this embodiment is almost the same as the block diagram of the first embodiment shown in FIG. 1, only the differing parts are shown and explained. First, we will let the overall number of scan lines from scan electrode-S 113 to scan electrode-E 114 be 230 lines in this embodiment.

A difference between this embodiment and FIG. 1 is the scan electrode drive circuit 1107. FIG. 11 shows the scan electrode drive circuit 1107 used in this embodiment. Scan electrode drive circuit 1107 consists of output block 1112 and input/output control block 111. Input/output control block 111 is the same as in FIG. 1, its internal circuit being as shown in FIG. 2. The two blocks are connected by seven signal lines, of which four are scan electrode drive voltages, the remaining three being the scan start signal TPR, the scan selection signal CK, and a scan mode setting signal M.

The output block 1112 within the scan electrode drive circuit 1107 has a subsampling (periodic line-skipping) function that enables display without non-displayed areas at the top and bottom of the image, even with the NTSC and PAL systems, which have a different number of scan lines, by having the mode set by an externally applied mode setting signal M. The subsampling method is that of providing one rest interval for every seven horizontal intervals, this resulting in 32 unsampled lines when sequentially scanning from scan electrodes 113 to scan electrode-E 114, so that a 262-line PAL picture is displayed on a total of 230 scan lines. When the input scan mode setting signal M is 1, this subsampling is not done, and when the signal is 0, subsampling is done. In this embodiment, controller 101 has a function which distinguishes whether the system of the video signal 102 is NTSC or PAL.

First, the case in which an NTSC system image is displayed by the liquid crystal display device system will be described. When the controller 101 determines that the input video signal 102 is an NTSC signal, the various signals are output to the scan electrode drive circuit 1107 with the timing shown in FIG. 12. Of the signals shown in FIG. 12, the scan start signal TPR, CL2, signal latch clock CL, and scan selection signal 202 have the same timing as shown in FIG. 3. The output of the switching signal 202 at this time is at state 1 and is input to the scan mode selection signal M. Therefore, output block 1112 is set for no subsampling and, as shown in FIG. 12, sequential selection is made starting from scan electrodes 113 to scan electrodes S+1 and S+2, enabling NTSC system display.

The case of PAL system picture display will be described next. When the controller 101 determines that the system is PAL, the various signals are output to the scan electrode drive circuit 1107 with the timing shown in FIG. 13. Of the signals shown in FIG. 13, TPR, CL2, CL, and CK have the same timing as in FIG. 5. The switching signal 202 at this time is different than in the just-described case of NTSC, this being at the state of 1 and input to the mode setting signal M. Therefore, output block 1112 is set for subsampling and, as shown in FIG. 13, scan electrode-S 113 is selected, the very next CK being skipped, and scan electrode S+2 being selected at the next CK after that. This subsampling (line skipping) is performed each 7 lines to enable PAL system display.

In this manner, automatic determination is made of the broadcast system of the video signal 102, and by setting the scan electrode drive circuit 1107 scanning mode for display on one and the same liquid crystal display device by means of the phase relationship between TPR and CK, then it is not necessary to output a scan mode setting signal from the controller, so that it is possible to eliminate input/output terminals from the scan electrode drive circuit 1107, thereby enabling connection of FPC110 to the short side of the scan electrode drive circuit 1107.

While the preceding has been a description of this embodiment in the case when the number of scan electrodes is 230, if accommodations are made in the scan electrode drive circuit 1107, this embodiment is not limited to this number. In addition, although in this embodiment the display method was switched according to the broadcast system, it is also possible to use the same method to set it for a different display system, for example a display system for office equipment such as a personal computer. While this embodiment used automatic determination of the display system, it is not limited to this method, and is effective even if manual switching of the display system is used. Further, while the aspect ratio changes when subsampling is done, if there is a subsampling setting function for the signal electrode drive circuit 103 as well to serve as an aspect ratio setting function, by adding the circuit of FIG. 2 to the signal electrode drive circuit 103 also, setting is possible by means of the phase lead/lag relationship between the two signals CL and CL2.

(Third Embodiment)

Figure 14:
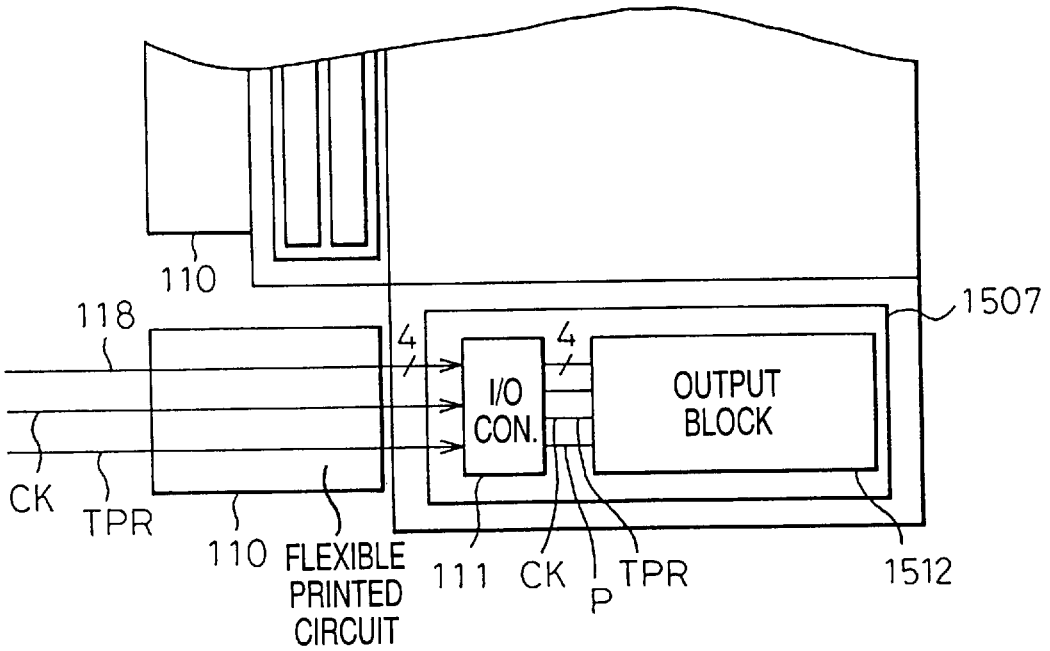
FIG. 14 is the scan electrode drive circuit which is a constituent element of the third embodiment of the present invention.

Next, the third embodiment of the present invention will be described, with reference made to FIG. 14 through FIG. 16. Since the block diagram of this embodiment is almost the same as the block diagram of the first embodiment shown in FIG. 1, only the differing parts are shown and explained. The difference in the embodiment from FIG. 1 is the scan electrode drive circuit 1070. FIG. 14 shows the scan electrode drive circuit 1507, which is a constituent element of this embodiment. Scan electrode drive circuit 1507 consists of input/output control block 111 and output block 1512. Input/output block 111 is the same as in FIG. 1, the internal circuit being as shown in FIG. 2. The two blocks are connected by seven signal lines, of which four are scan electrode drive voltages,, the remaining three lines being the scan start signal TPR, the scan selection signal CK, and the polarity signal P. The scan electrode drive voltage are the voltages applied to each of the electrodes from the scan electrode drive circuit 1507, these being the positive write voltage Vs when writing positively to the LCD, the negative write voltage Vsb when writing negatively to the LCD, and the positive hold voltage Vh and negative hold voltage Vhb which hold the written electrical charges. The scan start signal TPR and scan selection signal CK are the same as in the first embodiment. The polarity signal P is at a terminal that sets the positive/negative polarity of the writing voltage and hold voltage when sequentially scanning from scan electrode-S 113 to scan electrode-E 114. When the polarity signal P is 1, positive writing is done at scan electrode-S 113, negative writing is done at the second scan electrode, and positive writing is done at the third scan electrode. That is, writing starts with positive writing and the drive polarity alternates with each line. If the polarity signal P is 0, the polarity of writing is reversed, with negative writing at scan electrode-S 113, positive writing at the second scan electrode, and negative writing at the third electrode. That is, writing starts with negative writing and the drive polarity alternates with each line. Therefore, if the 1 and 0 states of this polarity signal are reversed for each field, drive in which the polarity alternates with each field is possible.

Figure 15:
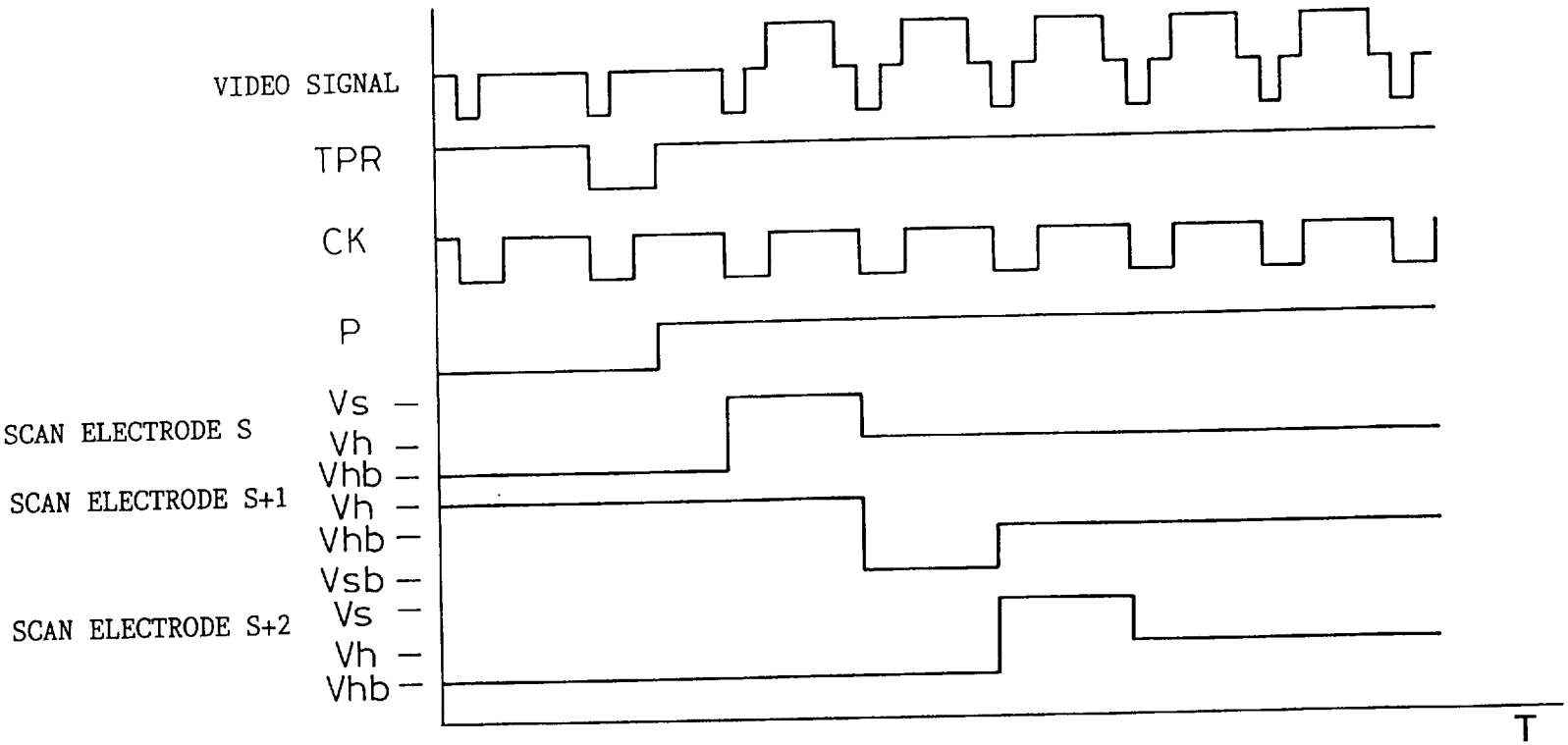
FIG. 15 is a timing chart in the case in which the first scan electrode is started at a positive write in the third embodiment of the present invention.

FIG. 15 shows the timing of each of the signals for the first field. The falling edge of TPR is synchronized with the horizontal synchronization of the video signal 102, and is of a phase such that it rises when OK is 1. CK is output in synchronization with the horizontal synchronization. At this time, by means of the internal circuit within the input/output control block 111 inside the scan electrode drive circuit 1507, CK is latched on the rising edge of TPR, and the switching signal 202 becomes 1. Because this switching signal 202 is connected to the polarity signal P at the output block 1512 inside the scan electrode drive circuit 1507, polarity signal P becomes 1 in synchronization with the rising edge of TPR. Therefore, the waveform applied to scan electrode-S 113 is Vs, this being held by the voltage Vh, the waveform applied to the next electrode S+1 is Vsb, this being held by the voltage Vhb, and the waveform applied to the next electrode S+2 after that is Vs, this being held by the voltage Vh.

Figure 16:
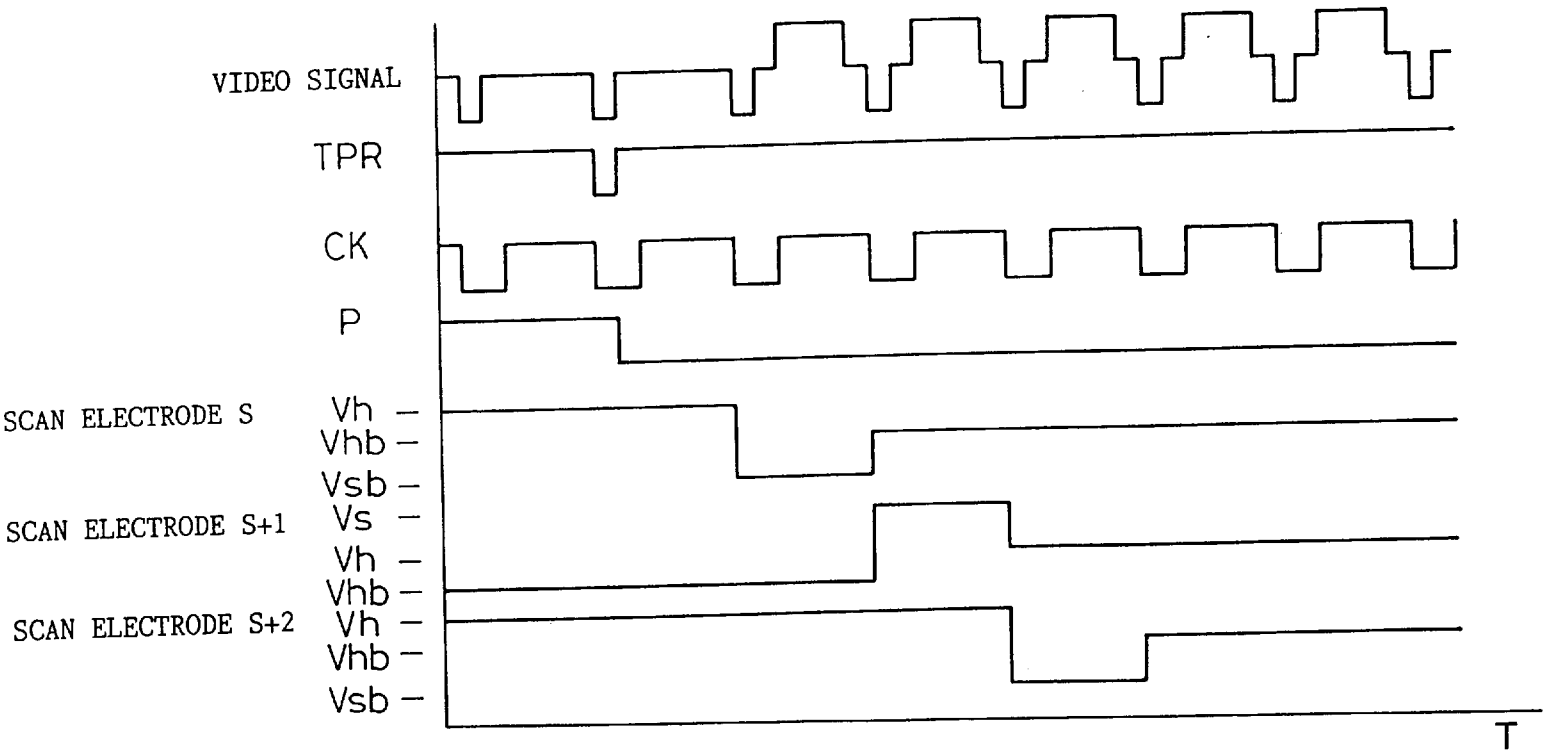
FIG. 16 is a timing chart in the case in which the first scan electrode is started at a negative write in the third embodiment of the present invention.

FIG. 16 shows the timing of each of the signals for the second field. The falling edge of TRP is synchronized with the horizontal synchronization of the video signal 102, and the rising edge of this signal occurs when CK is 0. The timing of CK is the same as for the first field. At this time, the switching signal of the input/output block 111 becomes 0 at the rising edge of TPR, as shown in FIG. 2. Therefore, the polarity signal P becomes 0, and the waveform applied to scan electrodes 113 is Vsb, this being held by voltage Vhb, the waveform applied to the next S+1 scan electrode is Vs, this being held by voltage Vh, and the waveform applied to the next S+2 scan electrode after that is Vsb, this being held by voltage Vhb.

In accordance with FIG. 15 and FIG. 16, it can be seen that the waveforms applied to each of the scan electrodes alternate in polarity between the first and second fields.

AS can be seen from the above description, because control of the drive polarity is controlled by means of the phase relationship between TPR and CK, it is not necessary to provide an externally input polarity signal P. Therefore, it is possible to reduce the number of input/output terminals on the scan electrode drive circuit 1507, enabling connection of FPC110 to the short side of the scan electrode drive circuit 1507.

In performing alternating drive, it is necessary to switch the voltage to be applied to the signal electrodes in synchronization with the switching of the write voltage to be applied to the scan electrodes. In this case as well, it is possible to use the phase relationship between two arbitrary control signals (for example CL and CL2) of the signal electrode drive circuit 103 to control the polarity, in the same manner as is done with the scan electrode drive circuit 1507.

AS can be seen from the preceding description, in a liquid crystal display device according to the present invention, the setting of the operating condition of the scan electrode drive circuit is established by the phase relationship between the scan start signal TPR and the scan selection signal CK, and the setting the of the operating condition of the signal electrode drive circuit is established by the phase relationship between the latch signal CL and the signal electrode output timing signal CL2, thereby enabling elimination of terminals for the purpose of setting these operating conditions. As a result, the number of input/output terminals is reduced, and it is possible to provide input/output terminals on the short side of the scan electrode drive circuit or of the signal electrode drive circuit, thereby enabling the implementation of a compact LCD panel.

We claim:

1. A liquid crystal display device comprising a liquid crystal panel and a scan electrode drive circuit and signal electrode drive circuit which drive the liquid crystal panel in accordance with signals from a controller, said scan electrode drive circuit and said signal electrode drive circuit each settable to at least two operating states, wherein a means of detecting the mutual phase lead/lag relationship of two arbitrary signals which differ in phase is provided within said scan electrode drive circuit or signal electrode drive circuit, said operating states of either said scan electrode drive circuit or said signal electrode drive circuit being set as a result of detecting the mutual phase relationship of said two arbitrary signals which differ in phase; wherein said means of detecting the phase lead/lag relationship between said two arbitrary signals which differ in phase is provided with a D-type flip-flop, one of two said arbitrary signals being connected to the data input of said D-type flip-flop, and the other of two said signals being connected to the clock input of said D-type flip-flop, and whereby the data input signal is latched on either the rising edge or the falling edge of the clock input, and output at the Q the output of said D-type flip-flop is a signal which indicates the phase lead/lag relationship.

2. In a liquid crystal display device, comprising a liquid crystal panel, a controller, and a scan electrode drive circuit and a signal electrode drive circuit responsive to the controller for driving the liquid crystal panel, the improvement wherein:

at least one of the scan electrode drive circuit and the signal electrode drive circuit having two arbitrary on signals of different phase, the phase difference being less than 180°;

the scan electrode drive circuit and signal electrode drive circuit that have said arbitrary on signals of different phase further including:

means for detecting a mutual, phase lead/lag relationship of the respective two arbitrary signals; and means for generating a state control signal in accordance with the different phase relationship detected by the detecting means for setting the respective scan electrode drive circuit and the signal electrode drive circuit that have said arbitrary on signals of different phase to each of at least two settable operational states for controlling the direction of orientation of a displayed image, thereby enabling elimination of terminals for the setting of the operational conditions.

3. A liquid crystal display device according to claim 2 wherein the scan electrode drive circuit has the two arbitrary on signals of different phase and the state control signal sets the scan electrode drive circuit to an upward or downward direction of scan.

* * * * *

UNITED STATES PATENT AND TRADEMARK OFFICE

CERTIFICATE OF CORRECTION

PATENT NO. : 5,861,862
DATED : January 19, 1999
INVENTOR(S) : Takashi AKIYAMA

It is certified that error appears in the above-identified patent and that said Letters Patent is hereby corrected as shown below:

Claim 1, Col. 8, line 63, "at the Q the output" should read --at the Q output--.

Claim 1, Col. 8, line 64, "D-type flip-flop is a signal" should read --D-type flip-flop as a signal--.

Signed and Sealed this

Fourth Day of April, 2000

*Attest:*

Q. TODD DICKINSON

*Attesting Officer*

*Director of Patents and Trademarks*